US010716438B2

(12) United States Patent
Jones

(10) Patent No.: US 10,716,438 B2
(45) Date of Patent: Jul. 21, 2020

(54) WATER-FED POLE FOR WINDOW CLEANING

(71) Applicant: EX-CEED INNOVATION LTD, West Midlands (GB)

(72) Inventor: Steven Jones, West Midlands (GB)

(73) Assignee: EX-CEED INNOVATION LTD, West Midlands (GB)

( * ) Notice: Subject to any disclaimer, the term of this patent is extended or adjusted under 35 U.S.C. 154(b) by 0 days.

(21) Appl. No.: 16/055,723

(22) Filed: Aug. 6, 2018

(65) Prior Publication Data

US 2019/0038092 A1 Feb. 7, 2019

(30) Foreign Application Priority Data

Aug. 4, 2017 (GB) ..... 1712586.5

(51) Int. Cl.
*A47L 1/08* (2006.01)
*B08B 3/02* (2006.01)
*B08B 1/00* (2006.01)

(52) U.S. Cl.
CPC ..... *A47L 1/08* (2013.01); *B08B 1/005* (2013.01); *B08B 3/02* (2013.01); *B08B 3/028* (2013.01)

(58) Field of Classification Search
CPC ..... A47L 1/08; A47L 1/00; A47L 1/06; A47L 1/15; A47L 4/02; B05C 17/00; B05C 17/002; B05C 17/005; B05C 17/00503; B08B 1/005; B08B 3/02; B08B 3/026
See application file for complete search history.

(56) References Cited

U.S. PATENT DOCUMENTS 6,045,284 A * 4/2000 Chiu ..... A46B 11/063 15/144.4
6,322,006 B1 * 11/2001 Guo ..... B05B 15/628 239/532
7,673,910 B2 * 3/2010 Moon ..... F16L 33/24 285/302

(Continued)

FOREIGN PATENT DOCUMENTS

CN 202402413 U 8/2012
CN 205093798 U 3/2016

(Continued)

OTHER PUBLICATIONS

Search Report under Section 17 for GB1712586.5 dated Feb. 1, 2018 (4 pages).

*Primary Examiner* — David J Walczak
(74) *Attorney, Agent, or Firm* — Carter, DeLuca & Farrell LLP; George Likourezos

(57) ABSTRACT

A water-fed pole for window cleaning including: an extendable pole having two or more pole sections, the pole sections being moveable relative to each other, in use, to extend and shorten the pole; and one or more clamps, each clamp being coupled to a given pole section and being operable to clamp the given pole section to an adjacent pole section, thereby fixing, in use, the length of the pole. Each clamp including a clamping surface arranged such that, on operation of the clamp, the clamping surface is brought into contact with a surface of the adjacent pole section to clamp the given pole section to the adjacent pole section. The at least a portion of the clamping surface made up of a resilient material.

21 Claims, 5 Drawing Sheets

(56) References Cited

U.S. PATENT DOCUMENTS

| | | | | |
|---|---|---|---|---|
| 8,832,910 | B2 * | 9/2014 | Lah | A63C 11/221<br>24/19 |
| 2003/0071142 | A1 | 4/2003 | Pohorecki | |
| 2014/0294496 | A1 * | 10/2014 | Gardiner | F16B 7/1454<br>403/374.2 |

FOREIGN PATENT DOCUMENTS

| | | | |
|---|---|---|---|
| GB | 1211028 | A | 11/1970 |
| GB | 2527741 | A | 1/2016 |
| GB | 2534139 | A | 7/2016 |

* cited by examiner

WATER-FED POLE FOR WINDOW CLEANING

The present invention relates to equipment for window cleaning, in particular to water-fed poles for window cleaning and systems comprising water-fed poles.

By using a water-fed pole, a window cleaner can clean windows on upper floors of buildings without having to work at height, e.g. climb ladders or scaffolding. Accordingly, the cleaning of windows on upper floors of buildings using a water-fed pole may be relatively safe and/or quick and/or inexpensive.

A water-fed pole comprises a long, typically extendable (e.g. telescopic), hollow pole having at a distal end a cleaning tool. Water is fed from a high pressure source to the cleaning tool via a hose running up the inside of the pole. Clamps are typically provided on the extendable pole to hold sections of the pole together when the pole is fully or at least partially extended.

A problem with known water-fed poles for window cleaning is wear of the pole sections caused by the clamps. Such wear can significantly shorten the service lifetime of a water-fed pole. For instance, wear may result in the clamps being unable to effectively hold sections of the pole together, in use.

Another problem with known water-fed poles is that grit and other debris can get into the inside of the pole, which can cause wear of the pole. This may be a particular problem when cleaning windows during periods of inclement weather such as during winter. Again, such wear of the pole can significantly shorten the service lifetime of a water-fed pole.

A first aspect of the invention provides a water-fed pole for window cleaning comprising:

an extendable pole comprising two or more pole sections, the pole sections being moveable relative to each other, in use, to extend and shorten the pole; and one or more clamps, each clamp being coupled to a given pole section and being operable to clamp the given pole section to an adjacent pole section, thereby fixing, in use, the length of the pole;

wherein the or each clamp comprises a clamping surface arranged such that, on operation of the clamp, the clamping surface is brought into contact with a surface of the adjacent pole section to clamp the given pole section to the adjacent pole section, wherein at least a portion of the clamping surface comprises a resilient material.

Advantageously, the provision of the resilient material in the clamping surface helps to grip the surface of the adjacent pole section and/or to reduce wear between the clamping surface and the surface of the adjacent pole section.

The clamping surface may comprise a single, continuous surface. Alternatively, the clamping surface may comprise a plurality of discrete surface portions. One or more of the discrete surface portions may comprise the resilient material.

The clamping surface may comprise a sleeve or a portion thereof.

The resilient material may comprise a rubber. The resilient material may comprise an elastomeric material. For instance, the resilient material may be a polyurethane such as thermoplastic polyurethane (TPU).

The pole sections may be hollow at least in part. Hollow pole sections may be preferred, to minimise the weight of the water-fed pole and thereby increase manoeuvrability and improve ease of use.

Optionally, in use, the pole sections, e.g. hollow pole sections, may communicate with one another so that, for example, a hose can run along the inside of at least a portion of the pole Typically, the pole sections may comprise, or consist essentially of, a lightweight composite material such as carbon fibre.

Generally, a lightweight composite material such as carbon fibre may be preferred, to minimise the weight of the water-fed pole and thereby increase manoeuvrability and improve ease of use.

The extendable pole may comprise up to 10 pole sections. For instance, the extendable pole may comprise two, three, four, five, six, seven, eight, nine or ten pole sections.

The pole sections may be moveable longitudinally relative to each other.

The extendable pole may be telescopic.

Typically, the pole sections may decrease in diameter from the proximal (e.g. user) end to the distal (e.g. cleaning tool) end.

Each pole section may have a length of at least 50 centimetres and/or up to 3 metres or up to 2 metres.

The extendable pole may comprise up to 10 clamps or up to nine clamps. For instance, the water-fed pole may comprise one, two, three, four, five, six, seven, eight, nine or ten clamps.

The extendable pole may comprise a handle. The handle may be located at or near an end of the extendable pole, e.g. an intended lower or proximal end of the extendable pole.

At an end, e.g. a distal end, the extendable pole may be fitted with a cleaning tool. The cleaning tool may be permanently or releasably attached to the extendable pole.

In an embodiment, the cleaning tool may comprise a brush, a mop, a sponge or a wiper blade.

In an embodiment, a hose pipe may run alongside the extendable pole for at least a portion of the length of the extendable pole. The hose pipe may be insertable within the extendable pole. The hose pipe may run alongside, e.g. run along the inside of, the extendable pole for at least a portion of the length of the extendable pole. Typically, the hose pipe may run along the inside of the extendable pole for substantially the entire length of the extendable pole.

In an embodiment, the or each clamp may comprise a lever-operated cam operable to cause, in use, the clamping surface to come into and out of contact with the surface of an adjacent pole section.

In an embodiment, the or each clamp may comprise an anti-rotation bush configured to limit or prevent unwanted rotation of the lever-operated cam. For instance, when the given pole section is clamped to the adjacent pole section, the lever-operated cam or a part thereof may sit in the anti-rotation bush. The anti-rotation bush may comprise two opposing plates between which the lever-operated cam of a part thereof may sit.

One or more of the pole sections may be provided with a blade, e.g. a flexible blade, protruding from a surface, typically an outer surface. The blade(s) may extend in a lateral direction relative to the longitudinal axis of the pole section or in a direction having a lateral component relative to the longitudinal axis of the pole section. For instance, the blade(s) may extend around at least a portion of the perimeter, e.g. circumference, of the pole section. The blade(s) may have the form of an annulus or a portion thereof. The blade(s) may have the form of a helix or a portion thereof. The blade(s), e.g. flexible blade(s), may extend around the perimeter, e.g. circumference, of the pole section. The blade(s) may comprise, or consist essentially of, a polymeric material.

Advantageously, for example, when a given pole section is moved longitudinally inside another of the pole sections, the blade may dislodge debris such as dirt and/or grit from the inner surface of the other pole section. Accordingly, the build-up of debris such as dirt and/or grit may be minimised. As a consequence, the service lifetime of the water-fed pole may be improved.

A second aspect of the invention provides a water-fed pole for window cleaning comprising:

an extendable pole comprising two or more pole sections, the pole sections being moveable relative to each other, in use, to extend and shorten the pole; and one or more clamps, each clamp being coupled to a given pole section and being operable to clamp the given hollow pole section to an adjacent pole section, thereby fixing, in use, the length of the pole, wherein the or each clamp comprises a clamping surface arranged such that, on operation of the clamp, the clamping surface is brought into contact with a surface of the adjacent pole section to clamp the given pole section to the adjacent pole section;

wherein one or more of the pole sections is provided with a blade protruding from a surface.

The or each blade may be flexible.

The or each blade may protrude from an outer surface of a given pole section.

The or each blade may extend in a lateral direction relative to the longitudinal axis of the pole section or in a direction having a lateral component relative to the longitudinal axis of the pole section. For instance, the blade may extend around at least a portion of the perimeter, e.g. circumference, of the pole section. The blade may have the form of an annulus or a portion thereof. The blade may have the form of a helix or a portion thereof. The blade, e.g. flexible blade, may extend around the perimeter, e.g. circumference, of the pole section. The blade may comprise, or consist essentially of, a polymeric material.

Advantageously, when a given pole section is moved relative to an adjacent pole section, the blade may dislodge dirt and/or grit from the surface of the adjacent pole section. Accordingly, the build-up of dirt and/or grit may be minimised. As a consequence, the service lifetime of the water-fed pole may be improved.

At least a portion of the clamping surface may comprise a resilient material.

Advantageously, the provision of the resilient material in the clamping surface helps to grip the surface of the adjacent pole section and/or to reduce wear between the clamping surface and the surface of the adjacent pole section.

The clamping surface may comprise a single, continuous surface. Alternatively, the clamping surface may comprise a plurality of discrete surface portions. One or more of the discrete surface portions may comprise the resilient material.

The clamping surface may comprise a sleeve or a portion thereof.

The resilient material may comprise a rubber. The resilient material may comprise an elastomeric material. For instance, the resilient material may be a polyurethane such as thermoplastic polyurethane (TPU).

The pole sections may be hollow at least in part. Hollow pole sections may be preferred, to minimise the weight of the water-fed pole and thereby increase manoeuvrability and improve ease of use.

Optionally, in use, the pole sections, e.g. hollow pole sections, may communicate with one another so that, for example, a hose can run along the inside of at least a portion of the pole Typically, the pole sections may comprise, or consist essentially of, a lightweight composite material such as carbon fibre.

Generally, a lightweight composite material such as carbon fibre may be preferred, to minimise the weight of the water-fed pole and thereby increase manoeuvrability and improve ease of use.

The extendable pole may comprise up to 10 pole sections. For instance, the extendable pole may comprise two, three, four, five, six, seven, eight, nine or ten pole sections.

The pole sections may be moveable longitudinally relative to each other.

The extendable pole may be telescopic.

Typically, the pole sections may decrease in diameter from the proximal (e.g. user) end to the distal (e.g. cleaning tool) end.

Each pole section may have a length of at least 50 centimetres and/or up to 3 metres or up to 2 metres.

The extendable pole may comprise up to 10 clamps or up to nine clamps. For instance, the water-fed pole may comprise one, two, three, four, five, six, seven, eight, nine or ten clamps.

The extendable pole may comprise a handle. The handle may be located at or near an end of the extendable pole, e.g. an intended lower or proximal end of the extendable pole.

At an end, e.g. a distal end, the extendable pole may be fitted with a cleaning tool. The cleaning tool may be permanently or releasably attached to the extendable pole.

In an embodiment, the cleaning tool may comprise a brush, a mop, a sponge or a wiper blade.

In an embodiment, a hose pipe may run alongside the extendable pole for at least a portion of the length of the extendable pole. The hose pipe may be insertable within the extendable pole. The hose pipe may run alongside, e.g. run along the inside of, the extendable pole for at least a portion of the length of the extendable pole. Typically, the hose pipe may run along the inside of the extendable pole for substantially the entire length of the extendable pole.

In an embodiment, the or each clamp may comprise a lever-operated cam operable to cause, in use, the clamping surface to come into and out of contact with the surface of an adjacent pole section.

In an embodiment, the or each clamp may comprise an anti-rotation bush configured to limit or prevent unwanted rotation of the lever-operated cam. For instance, when the given pole section is clamped to the adjacent pole section, the lever-operated cam or a part thereof may sit in the anti-rotation bush. The anti-rotation bush may comprise two opposing plates between which the lever-operated cam of a part thereof may sit.

A third aspect of the invention provides a water-fed pole for window cleaning comprising:

an extendable pole comprising two or more pole sections, the pole sections being moveable relative to each other, in use, to extend and shorten the pole; and one or more clamps, each clamp being coupled to a given pole section and being operable to clamp the given pole section to an adjacent pole section, thereby fixing, in use, the length of the pole;

wherein the or each clamp comprises a clamping surface arranged such that, on operation of the clamp, the clamping surface is brought into contact with a surface of the adjacent pole section to clamp the given pole section to the adjacent pole section;

wherein the or each clamp further comprises a lever-operated cam operable to cause, in use, the clamping surface to come into and out of contact with the surface of the adjacent pole section; and an anti-rotation bush configured to limit or prevent unwanted rotation of the lever-operated cam.

Advantageously, the anti-rotation bush may assist in maintaining a more reliable and/or consistent grip of the clamping surface on the surface of the adjacent pole section during operation of a water-fed pole.

Optionally, when the given pole section is clamped to the adjacent pole section, the lever-operated cam or a part thereof may sit in the anti-rotation bush. For instance, the anti-rotation bush may comprise two opposing plates between which the lever-operated cam of a part thereof may sit.

At least a portion of the clamping surface may comprise a resilient material.

Advantageously, the provision of the resilient material in the clamping surface helps to grip the surface of the adjacent pole section and/or to reduce wear between the clamping surface and the surface of the adjacent pole section.

The clamping surface may comprise a single, continuous surface. Alternatively, the clamping surface may comprise a plurality of discrete surface portions. One or more of the discrete surface portions may comprise the resilient material.

The clamping surface may comprise a sleeve or a portion thereof.

The resilient material may comprise a rubber. The resilient material may comprise an elastomeric material. For instance, the resilient material may be a polyurethane such as thermoplastic polyurethane (TPU).

The pole sections may be hollow at least in part. Hollow pole sections may be preferred, to minimise the weight of the water-fed pole and thereby increase manoeuvrability and improve ease of use.

Optionally, in use, the pole sections, e.g. hollow pole sections, may communicate with one another so that, for example, a hose can run along the inside of at least a portion of the pole Typically, the pole sections may comprise, or consist essentially of, a lightweight composite material such as carbon fibre.

Generally, a lightweight composite material such as carbon fibre may be preferred, to minimise the weight of the water-fed pole and thereby increase manoeuvrability and improve ease of use.

The extendable pole may comprise up to 10 pole sections. For instance, the extendable pole may comprise two, three, four, five, six, seven, eight, nine or ten pole sections.

The pole sections may be moveable longitudinally relative to each other.

The extendable pole may be telescopic.

Typically, the pole sections may decrease in diameter from the proximal (e.g. user) end to the distal (e.g. cleaning tool) end.

Each pole section may have a length of at least 50 centimetres and/or up to 3 metres or up to 2 metres.

The extendable pole may comprise up to 10 clamps or up to nine clamps. For instance, the water-fed pole may comprise one, two, three, four, five, six, seven, eight, nine or ten clamps.

The extendable pole may comprise a handle. The handle may be located at or near an end of the extendable pole, e.g. an intended lower or proximal end of the extendable pole.

At an end, e.g. a distal end, the extendable pole may be fitted with a cleaning tool. The cleaning tool may be permanently or releasably attached to the extendable pole.

In an embodiment, the cleaning tool may comprise a brush, a mop, a sponge or a wiper blade.

In an embodiment, a hose pipe may run alongside the extendable pole for at least a portion of the length of the extendable pole. The hose pipe may be insertable within the extendable pole. The hose pipe may run alongside, e.g. run along the inside of, the extendable pole for at least a portion of the length of the extendable pole. Typically, the hose pipe may run along the inside of the extendable pole for substantially the entire length of the extendable pole.

One or more of the pole sections may be provided with a blade, e.g. a flexible blade, protruding from a surface, typically an outer surface. The blade(s) may extend in a lateral direction relative to the longitudinal axis of the pole section or in a direction having a lateral component relative to the longitudinal axis of the pole section. For instance, the blade(s) may extend around at least a portion of the perimeter, e.g. circumference, of the pole section. The blade(s) may have the form of an annulus or a portion thereof. The blade(s) may have the form of a helix or a portion thereof. The blade(s), e.g. flexible blade(s), may extend around the perimeter, e.g. circumference, of the pole section. The blade(s) may comprise, or consist essentially of, a polymeric material.

Advantageously, for example, when a given pole section is moved longitudinally inside another of the pole sections, the blade may dislodge debris such as dirt and/or grit from the inner surface of the other pole section. Accordingly, the build-up of debris such as dirt and/or grit may be minimised. As a consequence, the service lifetime of the water-fed pole may be improved.

Another aspect of the invention provides a system for use in window cleaning comprising: a water-fed pole according to the first aspect of the invention or a water-fed pole according to the second aspect of the invention or a water-fed pole according to the third aspect of the invention; a cleaning tool fitted to the water-fed pole; a high pressure source of water; and a hose pipe connecting and providing fluid communication between the high pressure source of water and the cleaning tool. Typically, the hose pipe may run alongside the extendable pole for at least a portion of the length of the pole.

For example, the hose pipe may run along the inside of the extendable pole for at least a portion of the length of the pole.

In an embodiment, the high pressure source of water may be configured to supply deionized water.

Another aspect of the invention provides a kit of parts arranged to be assembled to form a water-fed pole for window cleaning or a system for use in window cleaning as described herein.

The invention will now be described by way of example only with reference to the accompanying drawings in which.

Figure 1:
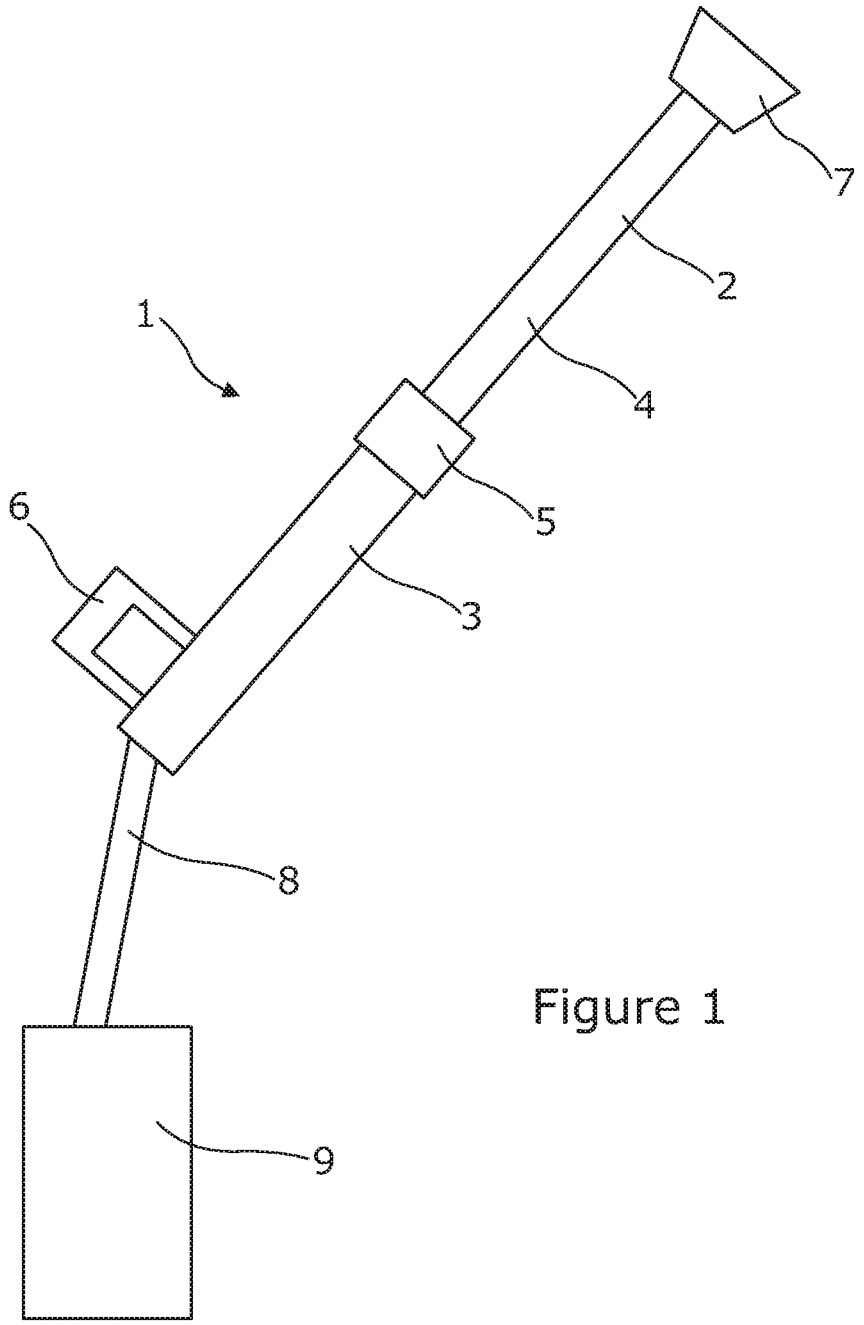
FIG. 1 shows a system for use in window cleaning according to an embodiment of the invention.
Figure 2:
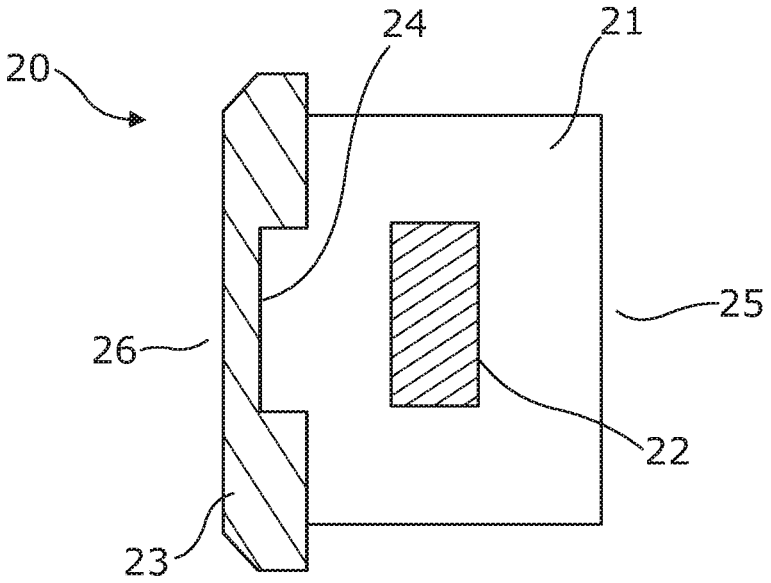
FIG. 2 shows a side view of a sleeve for use in a clamp on a water-fed pole according to the invention.
Figure 3:
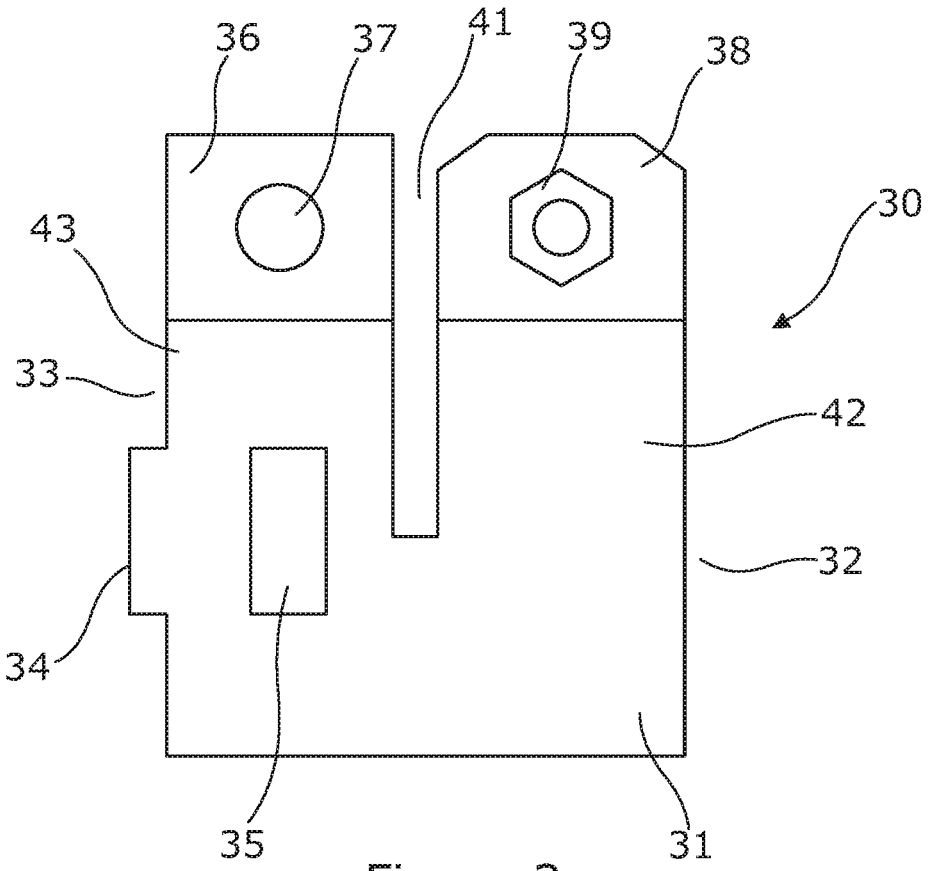
FIG. 3 shows a side view of a clamp body for use in a clamp on a water-fed pole according to the invention.

FIG. 1 shows a system 1 for use in window cleaning according to an embodiment of the invention. The system 1 comprises a telescopically extendable water-fed pole 2. The water-fed pole 2 comprises a first hollow pole section 3 and a second hollow pole section 4. The second hollow pole section 4 is thinner than the first hollow pole section 3. The second hollow pole section 4 fits within the first hollow pole section 3 and can move longitudinally relative to the first hollow pole section 3 to extend or shorten the water-fed pole 2. In FIG. 1, the water-fed pole 2 is shown in an extended state.

A clamp 5 according to the invention is fitted to a distal end of the first hollow pole section 3 and is operable to clamp the first hollow pole section 3 to the second hollow pole section 4, thereby fixing the length of the water-fed pole 2. In embodiments, the clamp 5 may comprise a clamping surface arranged such that, on operation of the clamp 5, the clamping surface is brought into contact with a surface of the second hollow pole section 4 to clamp the first hollow pole section 3 to the second hollow pole section 4. At least a portion of the clamping surface may comprise a resilient material. Typical features and operation of clamps according to the invention are described in more detail below.

Near a proximal end of the first hollow pole section 3 there is provided a handle 6 for a user to hold when using the system 1 to clean windows.

A cleaning tool 7 is fitted to a distal end of the second hollow pole section 4.

The system 1 further comprises a high pressure source of water 9. A hose pipe 8 connects and provides fluid communication between the high pressure source of water 9 and the cleaning tool 7. The hose pipe 8 passes along the inside of the first hollow pole section 3 and the second hollow pole section 4.

The water-fed pole may comprise more than two hollow pole sections. Each hollow pole section may be at least 50 centimetres and/or up to 3 metres or up to 2 metres long.

The hollow pole sections may comprise, or consist essentially of, carbon fibre or another lightweight composite material.

The cleaning tool may be permanently or releasably attached to the second hollow pole section. The cleaning tool may comprise a brush, a mop, a sponge or a wiper blade.

The high pressure source of water may be configured to supply deionised water.

The second hollow pole section may have a blade protruding from an outer surface. The blade may be arranged to dislodge debris such as grit or other dirt from the inner surface of the first hollow pole section when the second hollow pole section is moved longitudinally within the first hollow pole section. The blade may be flexible. The blade may be made from a polymeric material. The blade may extend around the circumference of the second hollow pole section.

Referring to FIGS. 2 to 6, there is shown some of the component parts of a clamp for use on a water-fed pole according to the invention. The parts are shown separately and together.

A first component part of the clamp comprises a sleeve 20 made of a resilient material, e.g. thermoplastic polyurethane (TPU). The sleeve 20 comprises a sleeve body 21 having a first open end 25 and a second open end 26. At the second open end 26, there is a flange 23 having a greater diameter than the sleeve body 21. The flange 23 has a recess 24, which is located on the outside of the sleeve body 21 and is open towards the first open end 25 of the sleeve body 21. There is another corresponding recess (not shown) on the opposite side of the sleeve body 21 from the recess 24.

The outside of the sleeve body 21 is provided with a rectangular protrusion 22, which extends radially outwards from the sleeve body 21 and is located approximately half way between the first open end 25 and the second open end 26. The rectangular protrusion 22 is arranged such that its shorter sides run parallel to a longitudinal axis of the sleeve body 21. There is another corresponding rectangular protrusion (not shown) on the opposite side of the sleeve body 21 from the rectangular protrusion 22.

Figure 4:
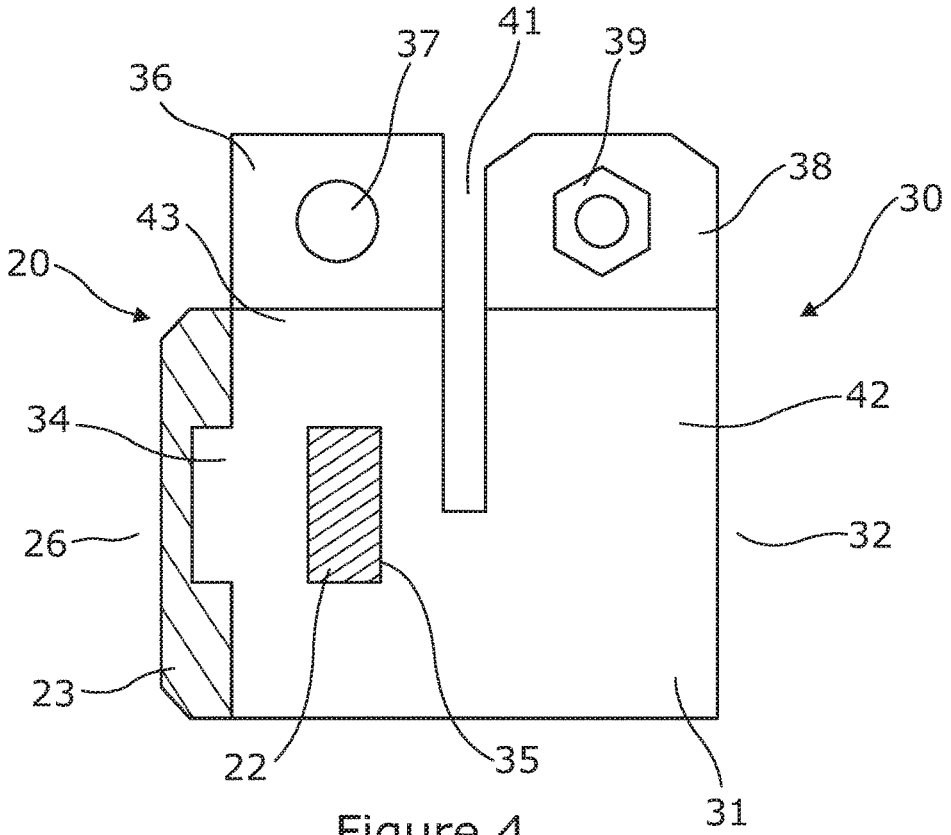
FIG. 4 shows a side view of the sleeve of FIG. 2 coupled to the clamp body of FIG. 3.
Figure 5:
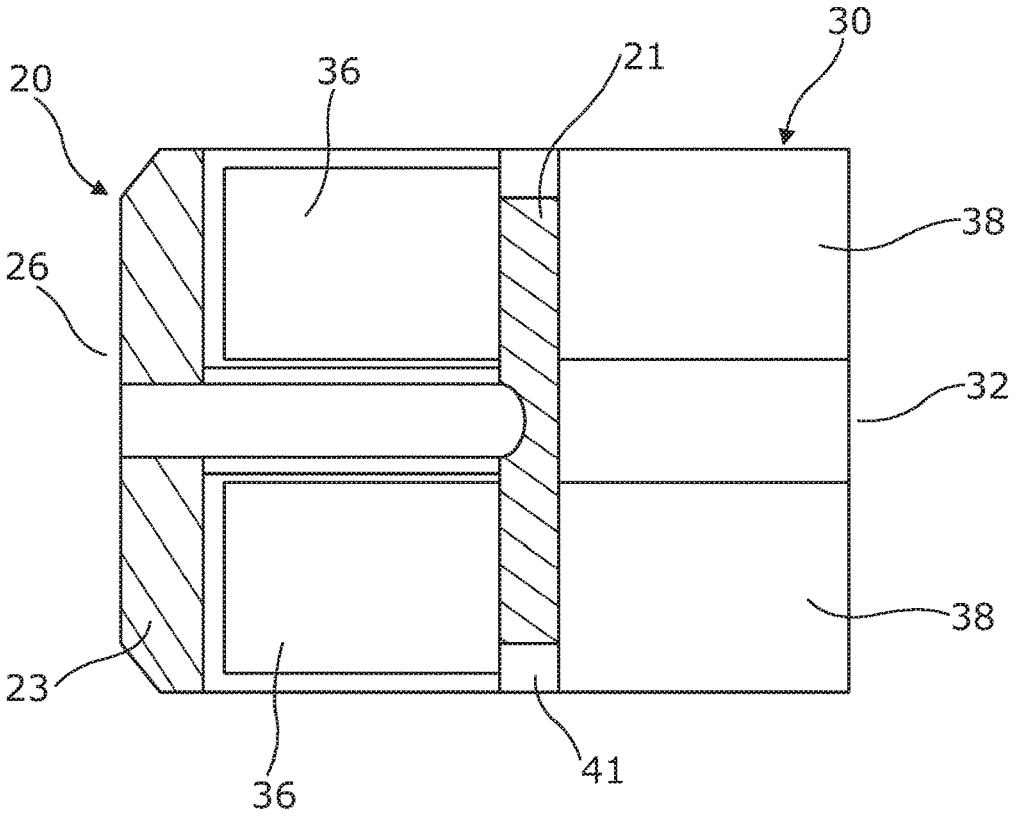
FIG. 5 is a top view of the sleeve and clamp body shown in FIG. 4.
Figure 6:
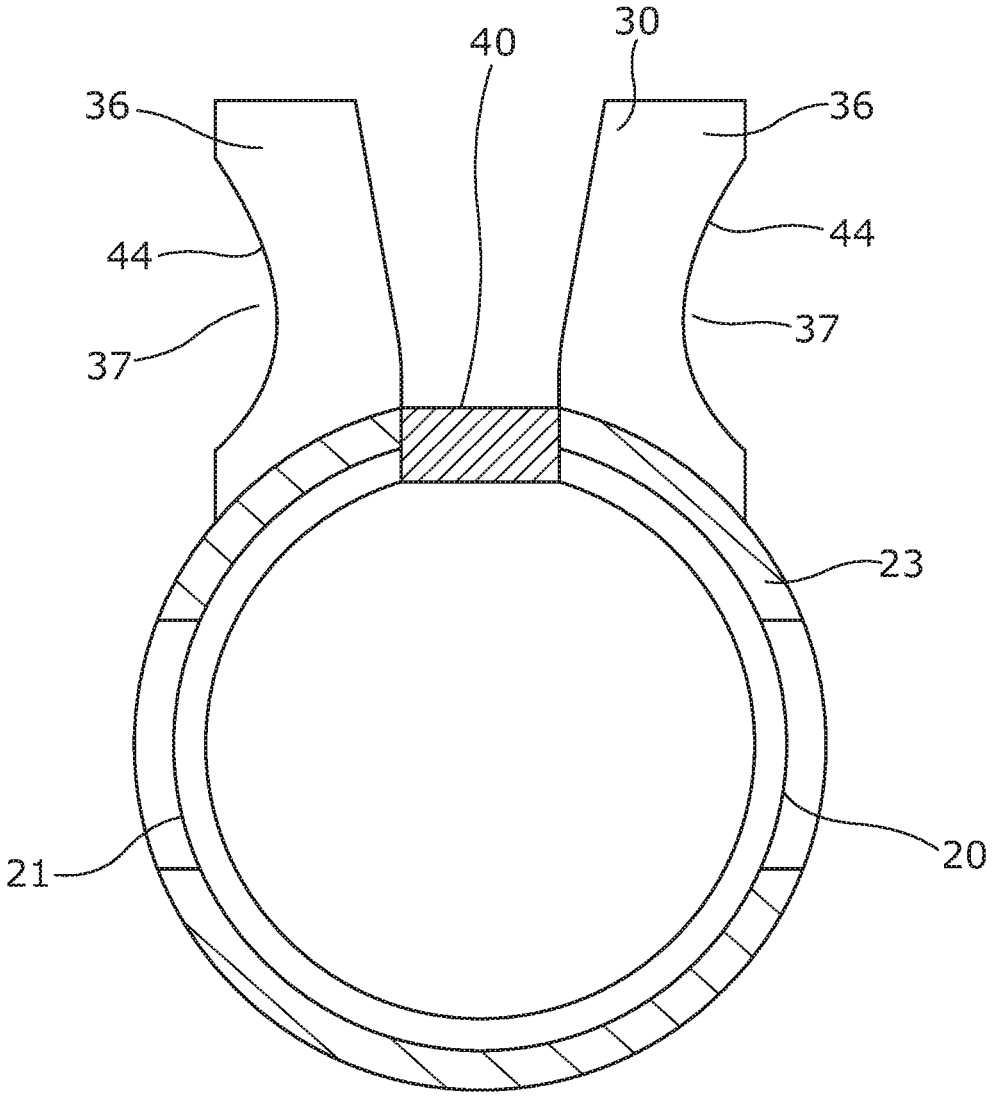
FIG. 6 is a front view of the sleeve and clamp body shown in FIGS. 4 and 5.

A second component part of the clamp comprises a clamp fitting 30. The clamp fitting 30 comprises a clamp body 31 having a first open end 32 and a second open end 33. As shown in FIGS. 4, 5 and 6, the sleeve 20 and the clamp fitting 30 are configured to engage with each other, in use. The clamp body 31 is shaped and dimensioned to receive, in use, the sleeve body 21.

At the second open end 33 of the clamp body 31 there is a locating formation 34. The locating formation 34 is arranged to be received in the recess 24. There is another corresponding locating formation (not shown) on the opposite side of the clamp body 31 from the locating formation 34.

Generally, the clamp body 31 has the form of a partially-split tube, in which the clamp body 31 has a first split 40 extending longitudinally from the second open end 33 to approximately half way along the length of the clamp body 31. The clamp body 31 comprises a first portion 42 and a second portion 43, which are separated by a second split 41, which is perpendicular to the first split 40 and extends approximately half way through the partially-split tube of the clamp body 31. The first portion 42 comprises the first open end 32. The second portion 43 comprises the second open end 33.

Extending from the first portion 42 is a first pair of securing fins 38. The first pair of securing fins 38 is connected together, in use, by a fastening means such as a nut and bolt 39.

Extending from the second portion 43 is a second pair of securing fins 36. The second pair of securing fins 36 is generally in alignment with the first pair of securing fins 38. The second pair of securing fins 36 is disposed either side of the first split 40. Each of the second pair of securing fins 36 comprises a concave portion 44 in its outward-facing face. Each of the second pair of securing fins 36 comprises a through hole 37 passing laterally through the securing fin 36 with one end opening into the concave portion 44. In use, a shaft (not shown) passes through the through holes 37. The shaft is coupled to an adjustment means such as a lever-operated cam (not shown) operable to urge the second pair of securing fins 36 together and thereby clamping the sleeve 20 to a pole section (not shown) located therein. The shaft may be threaded at least in part.

The second portion 43 further comprises a rectangular hole 35, which is configured to receive, in use, the rectangular protrusion 22 of the sleeve 20. It will be appreciated that the rectangular hole 35 and the rectangular protrusion 22 need not be rectangular. They can have any shape and dimensions such that they engage with one another, in use.

Similarly, the recess 24 and the locating formation 34 may be shaped and dimensioned other than as shown in the example embodiment of FIGS. 2 to 6, as long as they can engage with one another, in use.

Typically, the clamp body may comprise, or consist essentially of, a polymeric material, e.g. a plastic. The clamp body may be made from a single piece of material, e.g. polymeric material. Alternatively, the clamp body may be made from a plurality of parts, which are joined together, e.g. using an adhesive.

In use, the sleeve 20 is placed inside the second open end 33 of the clamp body 31, as shown in FIGS. 4, 5 and 6. Engagement between the recess 24 and the locating formation 34 and between the rectangular protrusion 22 and the rectangular hole 35 help to ensure that the sleeve 20 is correctly located and securely fitted within the clamp fitting 30.

In use, an end of a first hollow pole section (not shown) of a water-fed pole according to the invention is received in the first open end 32 of the clamp body 31. The clamp body 31 is fitted to the end of the first hollow pole section by tightening the nut and bolt 39 to grip and secure the end of the first hollow pole section within the first portion 42 of the clamp body 31.

The water-fed pole comprises a second hollow pole section having a smaller diameter than the first hollow pole section. The second hollow pole section fits inside the first hollow pole section and can move longitudinally relative to the first hollow pole section. In order to extend the length of the water-fed pole, the second hollow pole section is moved such that it extends out of the second hollow end 33 of the clamp body 31. A tightening mechanism such as a lever-operated cam coupled to a shaft passing through the through holes 37 in the second pair of securing fins 36 is operated to cause the sleeve 20 to grip the second hollow pole section, thereby fixing the length of the water-fed pole. To adjust the length of the water-fed pole, the tightening mechanism is released and the second hollow pole section is moved longitudinally relative to the first hollow pole section. Typically, the first hollow tube portion and the second hollow tube portion may be made from carbon fibre.

The grip of the sleeve on the second hollow tube portion may be improved and/or wear of the second hollow tube portion may be reduced, because the sleeve is made from a resilient material such as TPU.

Embodiments of the invention may include any number of hollow pole sections and a corresponding number of clamps.

Typically, a cleaning tool may be fitted to a distal hollow pole section. A handle may be provided on a proximal hollow pole section. Typically, the proximal hollow pole section may be the largest diameter hollow pole section in telescopically extendable embodiments of water-fed poles according to the invention.

The water-fed pole may be part of a system, which additionally comprises a source of high pressure water. The source of high pressure water may be connected to the cleaning tool by a hose pipe, which conveniently may pass along the inside of the hollow pole sections.

In an embodiment, one or more of the hollow pole sections may comprise a blade protruding from an outer surface. The blade may be annular and typically may be made from a flexible material, e.g. a polymeric material. Thus, when a given hollow pole section provided with a blade on an outer surface thereof is moved longitudinally inside another of the hollow pole section, the blade may dislodge debris such as dirt and/or grit from the inner surface of the other of the hollow pole sections. Accordingly, the build-up of debris such as dirt and/or grit may be minimised. As a consequence, the in service lifetime of the water-fed pole may be improved.

Figure 7:
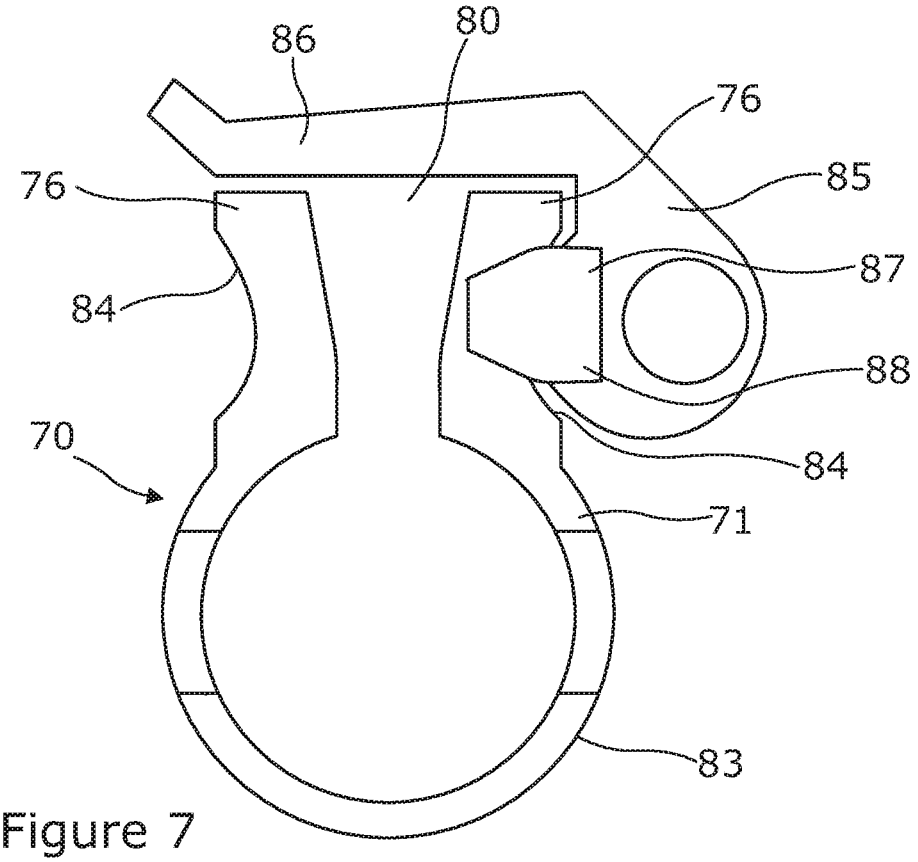
FIG. 7 is a front view of a clamp body for use in a clamp on a water-fed pole according to the invention.
Figure 8:
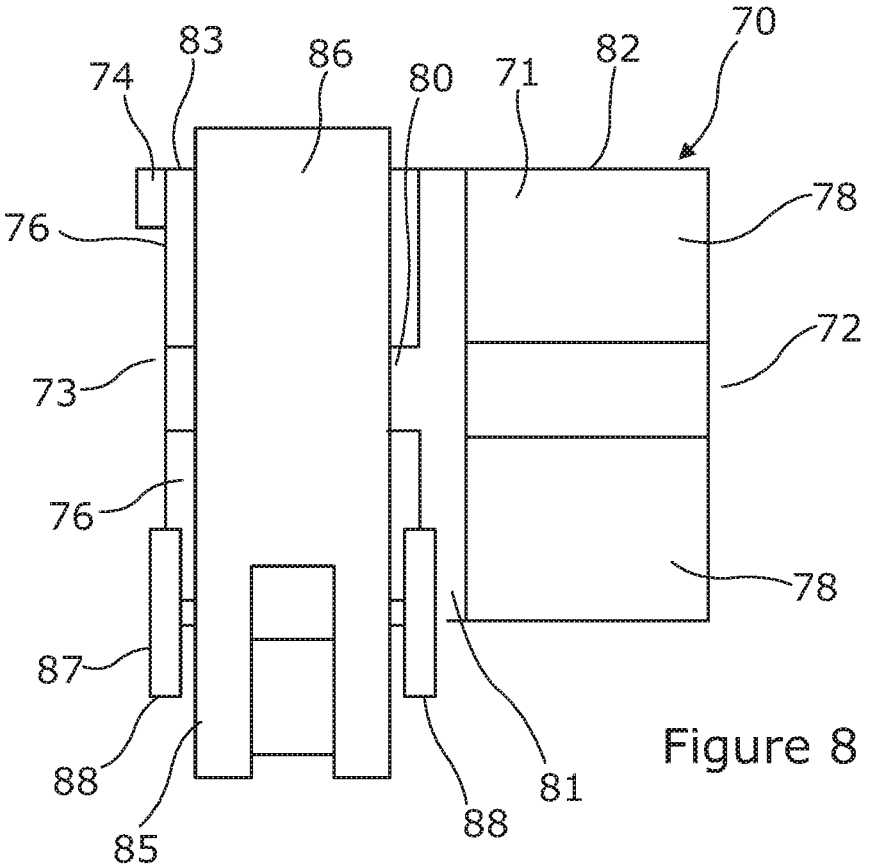
FIG. 8 is a top view of the clamp body shown in FIG. 7.

FIGS. 7 and 8 show another embodiment of a clamp fitting 70 for use in a clamp on a water-fed pole according to the invention. The clamp fitting 70 is configured for use with a sleeve (not shown) made of a resilient material such as TPU. The sleeve may be of the type described above in relation to FIGS. 2, 4, 5 and 6.

The clamp fitting 70 comprises a clamp body 71 having a first open end 72 and a second open end 73.

At the second open end 73 of the clamp body 71 there is a locating formation 74 for engagement, in use, with a correspondingly shaped recess on a sleeve. There is another corresponding locating formation (not shown) on the opposite side of the clamp body 71 from the locating formation 74.

Generally, the clamp body 71 has the form of a partially-split tube, in which the clamp body 71 has a first split 80 extending longitudinally from the second open end 73 to approximately half way along the length of the clamp body 71. The clamp body 71 comprises a first portion 82 and a second portion 83, which are separated by a second split 81, which is perpendicular to the first split 80 and extends approximately half way through the partially-split tube of the clamp body 71. The first portion 82 comprises the first open end 72. The second portion 83 comprises the second open end 73.

Extending from the first portion 82 is a first pair of securing fins 78. The first pair of securing fins 78 is connected together, in use, by a fastening means such as a nut and bolt (not shown).

Extending from the second portion 83 is a second pair of securing fins 76. The second pair of securing fins 76 is generally in alignment with the first pair of securing fins 78. The second pair of securing fins 76 is disposed either side of the first split 80.

The second portion 83 further comprises two holes (not shown) disposed on opposite sides of the clamp body 71, each hole being is configured to receive, in use, a correspondingly-shaped protrusion on a sleeve. It will be appreciated that the hole(s) and the protrusion(s) can have any shape and dimensions such that they engage with one another, in use.

Each of the second pair of securing fins 76 comprises a concave portion 84 in its outward-facing face. Each of the second pair of securing fins 76 comprises a through hole (not shown) passing laterally through the securing fin 76 with one end opening into the concave portion 84. In use, a shaft (not shown) passes through the through holes.

The clamp fitting 70 further comprises an adjustment means comprising a lever-operated cam 85, which is pivotally coupled to an end of the shaft passing through the through holes. The lever-operated cam 85 is operable to urge the second pair of securing fins 76 together, thereby clamping, in use, a sleeve (not shown) received within the second portion 83 of clamp body 71 to a pole section (not shown) located within the sleeve.

The lever-operated cam 85 comprises a lever handle 86 for a user to manipulate, in order to operate the clamp fitting 70. Conveniently, the lever-operated cam 85 is configured such that, when the clamp fitting 70 is at its tightest (i.e. with the second pair of securing fins 76 being pushed towards each other), the lever handle 86 lies flat across the tops of the second pair of securing fins 76 (as shown in FIGS. 7 and 8). In order to loosen the clamp fitting 70, a user operates the lever-operated cam 85 by moving the lever handle 86 away from the tops of the second pair of securing fins 76. Consequently, the lever-operated cam 85 effectively lengthens the shaft passing through the through holes in the second pair of securing fins 76, thereby allowing the second pair of securing fins 76 to move apart from one another.

The clamp fitting 70 further comprises an anti-rotation bush 87. The anti-rotation bush 87 comprises a pair of opposing end plates 88 joined by a central element (not shown). The central element comprises a through hole, thereby allowing the anti-rotation bush 87 to be mounted on the shaft passing through the through holes in the second pair of securing fins 76. The anti-rotation bush 87 is mounted on the shaft between the lever-operated cam 85 and the proximal securing fin 76. The opposing end plates 88 are disposed either side of the proximal securing fin 76 and the lever-operated cam 85 and act to limit or prevent, in use, unwanted rotation of the lever-operated cam 85. Therefore, a more reliable and/or consistent grip of a clamping surface on a surface of an adjacent pole section may be maintained during operation of a water-fed pole.

Typically, the clamp body may comprise, or consist essentially of, a polymeric material, e.g. a plastic. The clamp body may be made from a single piece of material, e.g. polymeric material. Alternatively, the clamp body may be made from a plurality of parts, which are joined together, e.g. using an adhesive.

In use, a sleeve, e.g. the sleeve 20, may be placed inside the second open end 73 of the clamp body 71.

In use, an end of a first hollow pole section (not shown) of a water-fed pole according to the invention is received in the first open end 72 of the clamp body 71. The clamp body 71 is fitted to the end of the first hollow pole section by tightening the nut and bolt (not shown) to grip and secure the end of the first hollow pole section within the first portion 82 of the clamp body 71.

The water-fed pole comprises a second hollow pole section having a smaller diameter than the first hollow pole section. The second hollow pole section fits inside the first hollow pole section and can move longitudinally relative to the first hollow pole section. In order to extend the length of the water-fed pole, the second hollow pole section is moved such that it extends out of the second hollow end 73 of the clamp body 71. The tightening mechanism comprising the lever-operated cam 85 pivotally coupled to the shaft passing through the through holes in the second pair of securing fins 76 is operated to cause a clamping surface provided for example by a sleeve engaged with the clamp body 71 to grip the second hollow pole section, thereby fixing the length of the water-fed pole. To adjust the length of the water-fed pole, the tightening mechanism is released and the second hollow pole section is moved longitudinally relative to the first hollow pole section. Typically, the first hollow tube portion and the second hollow tube portion may be made from carbon fibre.

The grip of the sleeve on the second hollow tube portion may be improved and/or wear of the second hollow tube portion may be reduced, because the clamping surface provided by the sleeve may be made at least in part from a resilient material such as TPU.

Embodiments of the invention may include any number of hollow pole sections and a corresponding number of clamps.

Typically, a cleaning tool may be fitted to a distal hollow pole section. A handle may be provided on a proximal hollow pole section. Typically, the proximal hollow pole section may be the largest diameter hollow pole section in telescopically extendable embodiments of water-fed poles according to the invention.

The water-fed pole may be part of a system, which additionally comprises a source of high pressure water. The source of high pressure water may be connected to the cleaning tool by a hose pipe, which conveniently may pass along the inside of the hollow pole sections.

In an embodiment, one or more of the hollow pole sections may comprise a blade protruding from an outer surface. The blade may be annular and typically may be made from a flexible material, e.g. a polymeric material. Thus, when a given hollow pole section provided with a blade on an outer surface thereof is moved longitudinally inside another of the hollow pole section, the blade may dislodge debris such as dirt and/or grit from the inner surface of the other of the hollow pole sections. Accordingly, the build-up of debris such as dirt and/or grit may be minimised. As a consequence, the in service lifetime of the water-fed pole may be improved.

While the invention has been described with reference to certain example embodiments, various modifications will be apparent to a person skilled in the art without departing from the scope of the invention.

The invention claimed is:

1. A water-fed pole for window cleaning and suitable for connecting to a source of high pressure water comprising:

an extendable pole comprising two or more pole sections, the pole sections being moveable relative to each other, in use, to extend and shorten the pole; and one or more clamps, each clamp being coupled to a given pole section and being operable to clamp the given pole section to an adjacent pole section, thereby fixing, in use, the length of the pole;

wherein the or each clamp comprises a clamping surface arranged such that, on operation of the clamp, the clamping surface is brought into contact with a surface of the adjacent pole section to clamp the given pole section to the adjacent pole section, wherein at least a portion of the clamping surface comprises a resilient material, wherein the clamping surface comprises a sleeve or a portion thereof, the sleeve comprising a sleeve body having a first open end and a second open end; and a clamp fitting comprising a clamp body having a first open end and a second open end;

wherein an end of the given pole section is received in the first open end of the clamp body and the sleeve is disposed inside the second open end of the clamp body; and wherein at the second open end of the sleeve body, there is a flange having a greater diameter than the sleeve body, the flange having a pair of recesses located on opposite sides of the outside of the sleeve body, each recess being open towards the first open end of the sleeve body; and at the second open end of the clamp body there is a pair of locating formations on opposite sides of the clamp body, each locating formation being received in one of the recesses on the outside of the sleeve body.

2. A water-fed pole according to claim 1, wherein the resilient material comprises an elastomeric material.

3. A water-fed pole according to claim 1, wherein the pole sections are hollow at least in part.

4. A water-fed pole according to claim 1, wherein the pole sections comprise a lightweight composite material.

5. A water-fed pole according to claim 4, wherein the lightweight composite material is carbon fiber.

6. A water-fed pole according to claim 1, wherein the extendable pole comprises up to 10 pole sections.

7. A water-fed pole according to claim 1, wherein, at an end, the extendable pole is fitted with a cleaning tool.

8. A water-fed pole according to claim 1, wherein the or each clamp comprises a lever-operated cam operable to cause, in use, the clamping surface to come into and out of contact with the surface of the adjacent pole section.

9. A water-fed pole according to claim 8, wherein the or each clamp comprises an anti-rotation bush configured to limit or prevent unwanted rotation of the lever-operated cam.

10. A water-fed pole according to claim 1, wherein one or more of the pole sections is/are provided with a blade protruding from a surface.

11. A water-fed pole according to claim 10, wherein the or each blade extends in a lateral direction relative to the longitudinal axis of the pole section or in a direction having a lateral component relative to the longitudinal axis of the pole section.

12. A water-fed pole according to claim 10, wherein the or each blade has the form of an annulus or a portion thereof or the blade has the form of a helix or a portion thereof.

13. A water-fed pole according to claim 1, wherein one or more of the pole sections is provided with a blade protruding from a surface.

14. A water-fed pole according to claim 1, wherein the or each clamp further comprises a lever-operated cam operable to cause, in use, the clamping surface to come into and out of contact with the surface of the adjacent pole section; and an anti-rotation bush configured to limit or prevent unwanted rotation of the lever-operated cam.

15. A system for use in window cleaning comprising: a water-fed pole according to claim 1; a cleaning tool fitted to the water-fed pole; a high pressure source of water; and a hose pipe connecting and providing fluid communication between the high pressure source of water and the cleaning tool.

16. A kit of parts arranged to be assembled to form a system for use in window cleaning according to claim 15.

17. A system according to claim 15, wherein the hose pipe runs alongside the extendable pole for at least a portion of the length of the pole.

18. A system according to claim 15, wherein the hose pipe runs along the inside of the extendable pole for at least a portion of the length of the pole.

19. A system according to claim 15, wherein the high pressure source of water is configured to supply deionized water.

20. A kit of parts arranged to be assembled to form a water-fed pole according to claim 1.

21. A water-fed pole according to claim 1, wherein one or more of the pole sections is/are provided with a blade protruding from an outer surface.

* * * * *